US005206891A

United States Patent [19]

Kishimoto

[11] Patent Number: 5,206,891

[45] Date of Patent: Apr. 27, 1993

[54] OPERATIONAL CONTROL COUNTER CIRCUITRY FOR ELECTRICAL APPARATUS

[75] Inventor: Hiroyuki Kishimoto, Toyokawa, Japan

[73] Assignee: Minolta Camera Kabushiki Kaisha, Osaka, Japan

[21] Appl. No.: 780,195

[22] Filed: Oct. 22, 1991

[30] Foreign Application Priority Data

Oct. 23, 1990 [JP] Japan ..... 2-286576

[51] Int. Cl.[5] ..... G06M 3/02

[52] U.S. Cl. ..... 377/55; 377/28; 377/30; 377/15; 355/112; 355/133

[58] Field of Search ..... 377/55, 28, 30, 15; 355/112, 133

[56] References Cited

U.S. PATENT DOCUMENTS 4,519,088 5/1985 Redemacher et al. ..... 377/30

*Primary Examiner*—William L. Sikes
*Assistant Examiner*—Scott A. Ouellette
*Attorney, Agent, or Firm*—Burns, Doane, Swecker & Mathis

[57] ABSTRACT

An electrical apparatus (e.g., copying apparatus) equipped with a counter for counting the number of specific cycles. Allowance or prevention of an operation cycle is controlled in accordance with voltage changes at a predetermined position of the controlling circuitry supplying a driving voltage to the counter. A specific operation of the electrical apparatus is enabled by connection of counter.

17 Claims, 6 Drawing Sheets

OPERATIONAL CONTROL COUNTER CIRCUITRY FOR ELECTRICAL APPARATUS

BACKGROUND OF THE INVENTION

1. Field of the Invention

This invention generally relates to an electrical apparatus provided with a counter for counting the number of specific operations of the apparatus, and more particularly, to an electrical apparatus designed to prevent unauthorized use of the electrical apparatus.

2. Description of Related Art

When a copying apparatus is lent to a user, a copying fee is charged based on the number of copies counted by a counter installed in the copying apparatus. Therefore, if the counter is detached from the copying apparatus during copying, it is impossible to correctly know the number of copies made and to collect a correct copying fee.

Therefore, conventionally, such a device as indicated in FIG. 1 is mounted to the copying apparatus to prevent unauthorized use of the copying apparatus. A main body 1 of the copying apparatus has counter connecting terminals 1*a*, 1*b*, 1*c*, 1*d*. The counter connecting terminal 1*a* is earthed. The counter connecting terminal 1*b* is connected to a power source V1 through a resistance R11 and also to an input port $\bar{a}$ of a CPU 2. The counter connecting terminal 1*c* is connected to a power source V2 whose voltage is higher than that of the power source V1. An output port $\bar{b}$ of the CPU 2 is connected to a power source V3 through a resistance R12 and to the counter connecting terminal 1*d* through an open-collector circuit 3. The counter connecting terminals 1*c*, 1*d* are connected both to a power terminal 4*c* of a counter 4 and to an actuating signal terminal 4*d* which supplies the actuating signal to the counter 4, through a connector CN. The counter 4 is started by the actuating signal. A counter relay CR is connected between the power terminal 4*c* and an actuating signal terminal 4*d*. An appropriate signal at activating signal terminal will increment the value of the counter 4.

In the case where the counter 4 is connected to a copying apparatus, since the counter connecting terminals 1*a*, 1*b* are short-circuited by a short circuit S therebetween, the input port a of the CPU 2 is at the "L" level. In this state, the CPU 2 is enabled to output an instruction (not shown) to start copying. Therefore, an actuating signal at the "L" level is output from the output port $\bar{b}$ of the CPU 2 to the open-collector circuit 3 to count a copy operation. This allows a current flow from the power source V2 to the open-collector circuit 3 through the counter relay CR, whereby the counting value of the counter 4 is increased one. The increased value is displayed.

Meanwhile, if the counter 4 is detached from the copying apparatus by separating the connector CN the voltage of the counter connecting terminal 1b is raised to that of the power source V1 and the input port $\bar{a}$ of the CPU 2 goes to the "H" level. The CPU 2 detects that the counter 4 is detached and prohibits generation of a copy instruction signal thereby making copying impossible.

In the manner as described hereinabove, unauthorized use of the copying apparatus has been prevented, and a correct counting of the number of copies made has been recorded by the counter.

In the aforementioned approach, however, if the counter connecting terminal 1*c* and power terminal 4*c* and, counter connecting terminal 1*d* and actuating signal terminal 4*d* are separated from each other at a position, for example, indicated by the broken line 5 in FIG. 1, the counter 4 will not function. Since the counter connecting terminals 1*a*, 1*b* are kept in the short-circuited state by the short circuit S of the counter 4, and the input port $\bar{a}$ of the CPU 2 is at the "L" level, generation of a copy instruction signal is not prohibited by the CPU 2. In such case as above, the counting value of the counter 4 is never updated even when copying is continued, resulting in the improper use of the counter.

SUMMARY OF THE INVENTION

One object of this invention is to provide an electrical apparatus which can perfectly prohibit a specific operation thereof in the event a counter is disconnected from the electrical apparatus.

Another object of this invention is to provide an electrical apparatus which can positively prevent the improper use of a counter.

An electrical apparatus embodied by this invention is provided with a counter for counting the number of specific operations of the electrical apparatus, a counter driving circuit which supplies a driving voltage to the counter on the basis of an actuating signal, monitoring means for monitoring a voltage at a predetermined position of the counter driving circuit, and controlling means for controlling performance/prohibition of the specific operation of the electrical apparatus in accordance with the monitoring result of the monitoring means.

Counter connection to an electrical apparatus, is detected by monitoring result a voltage within the counter driving circuit which enables the electrical apparatus to perform the specific operation. When the counter is disconnected from the electrical apparatus, disconnection is detected by monitoring a voltage within the counter driving circuit. Detection of a counter disconnected from the electrical apparatus prevents specific operation of the electrical apparatus.

The above and further objects and features of the invention will more fully be apparent from the following detailed description with accompanying drawings.

DESCRIPTION OF THE PREFERRED EMBODIMENTS

This invention will be depicted in more detail with reference to the accompanying drawings of the preferred embodiments thereof.

Figure 1:
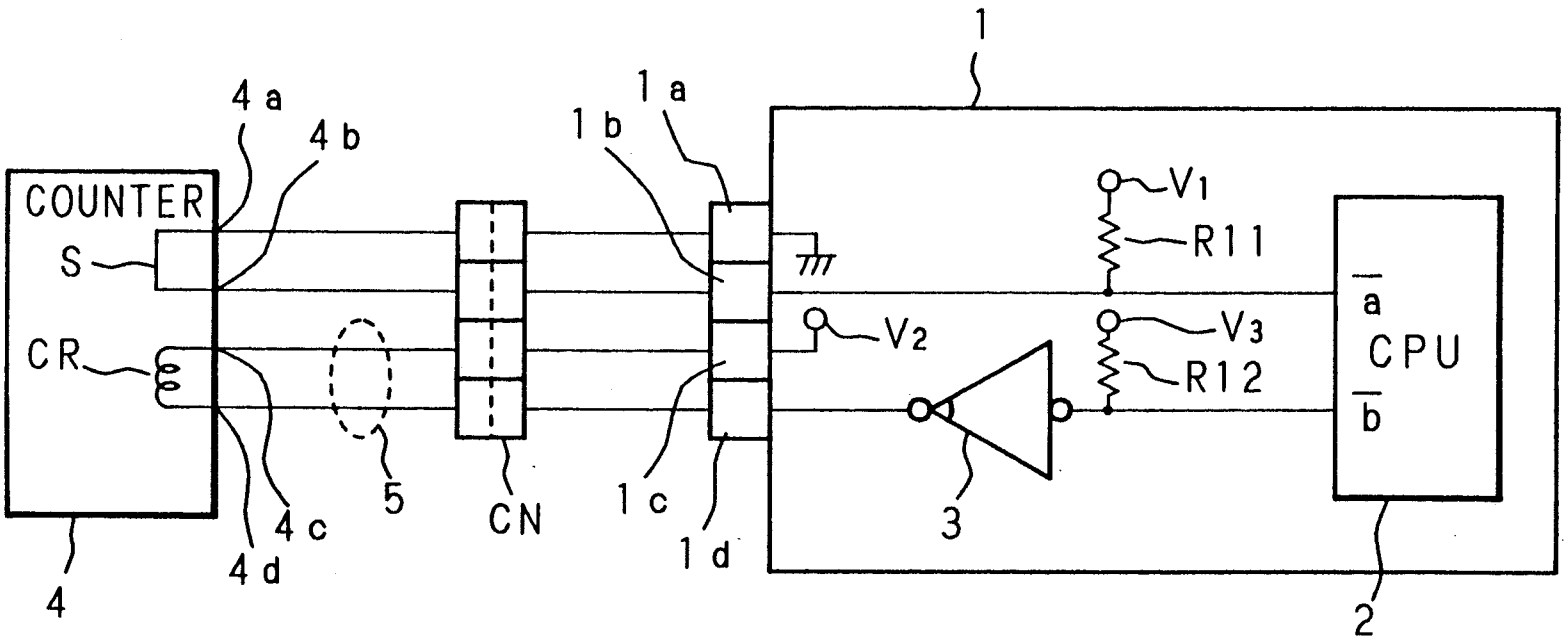
Fig. 1 Prior Art
FIG. 1 is a structural block diagram of a conventional electrical apparatus.
Figure 2:
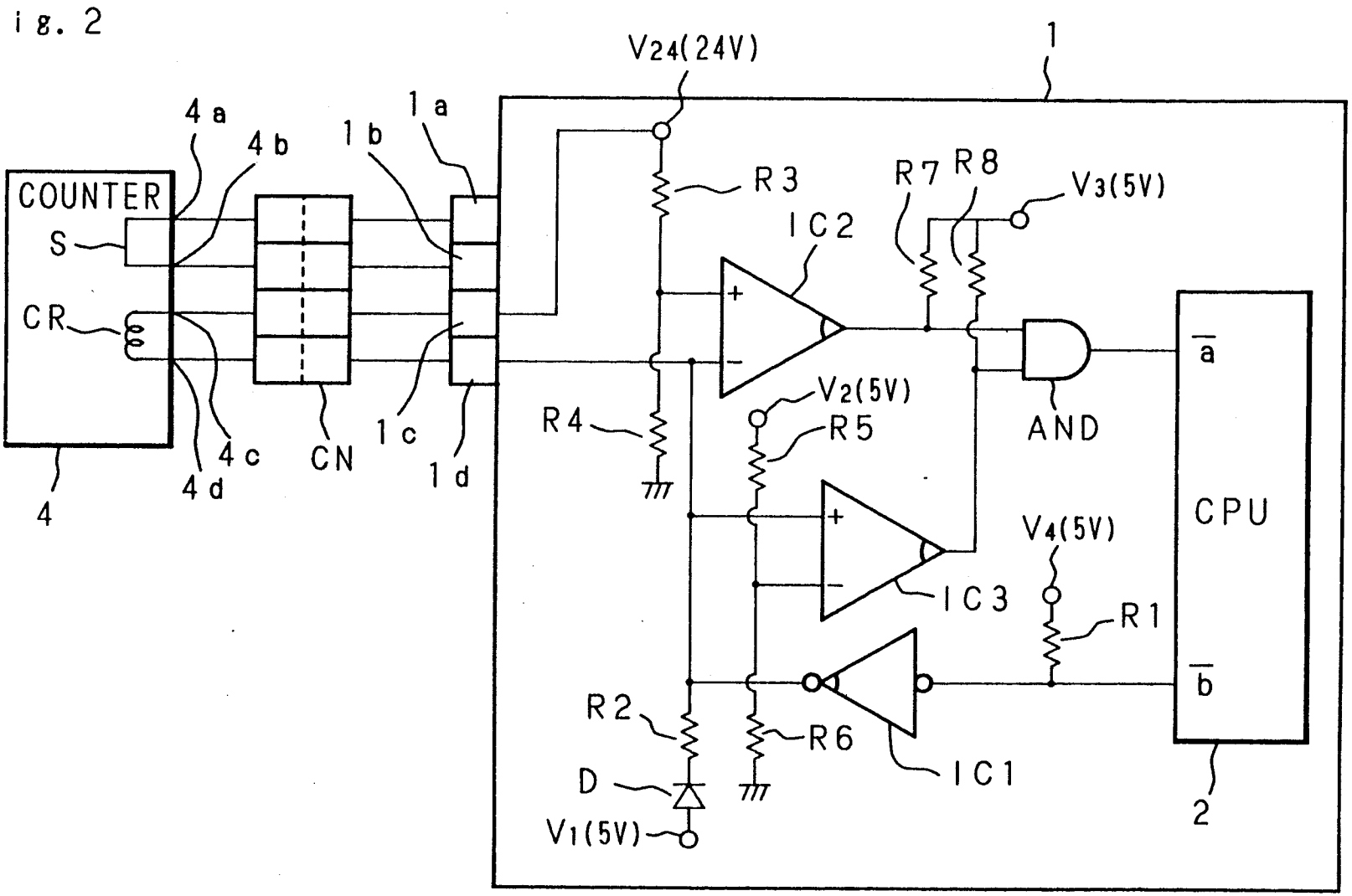
FIG. 2 is a structural block diagram of an electrical apparatus according to one preferred embodiment of this invention.

Referring to FIG. 2 showing an electrical apparatus of the first embodiment of this invention, a main body 1 of a copying apparatus with an electrical apparatus having counter connecting terminals 1*a*, 1*b*, 1*c*, 1*d*. The counter connecting terminal 1*c* is connected to a power source V24 of, for example, 24 V which is connected to a positive input terminal (+) of a comparator IC2 through a resistance R3. The positive input terminal (+) is grounded to the earth through a resistance R4. The counter connecting terminal 1*d* is connected to a negative input terminal (−) of the comparator IC2, a positive input terminal (+) of a comparator IC3, and an output side of an open-collector circuit IC1.

The threshold voltage of the positive input terminal (+) of the comparator IC2 is set to be 10 V, for instance. The threshold voltage of a negative input terminal (−) of the comparator IC3 is set, for example, at 3 V. A power source V1 of, e.g., 5 V is connected to the output side of the open-collector circuit IC1 through a series circuit consisting of a diode D having an anode connected to the power source V1 and a resistance R2. A second power source V2 is earthed through a series circuit comprised of resistances R5 and R6. A connecting part between the resistances R5 and R6 is connected to the negative input terminal (−) of the comparator IC3. A third power source V3 is, through a resistance R7, connected to an output terminal of the comparator IC2 and one input terminal of an AND circuit AND which works as the prohibiting means of specific operations (copying operations) of the electrical apparatus (copying apparatus). Power source V3 is further connected to the other input terminal of the AND circuit AND and an output terminal of the comparator IC3 through a resistance R8. The output terminal of the AND circuit AND is connected to an input port $\bar{a}$ of a CPU 2. An output port $\bar{b}$ of the CPU 2 is connected to an input side of the open-collector circuit IC1 and a forth power source V4 through a resistance R1. The open-collector circuit IC1 operates in such a manner that the output side thereof is at a high impedance when the input side is at the "H" level (generally 2–3 V or more), whereas it is changed to an "L" level (0.2–1 V) when the input side is at the "L" level (generally not larger than 0.8–1 V).

Each of the counter connecting terminals 1*a*, 1*b* of the main body 1 of the copying apparatus are respectively connected to short-circuit connecting terminals 4*a*, 4*b* of a counter 4 through a detachable connector CN. A short circuit S is connected between the connecting terminals 4*a* and 4*b*. The counter connecting terminals 1*c*, 1*d* are respectively connected to a power terminal 4*c* and an actuating signal terminal 4*d* of the counter 4 through the connector CN. A counter relay CR for actuating the counter 4 is connected between the terminals 4*c* and 4*d*.

The operation of the electrical apparatus in the above-discussed structure will be explained with reference to a timing chart of FIG. 3.

Figure 3:
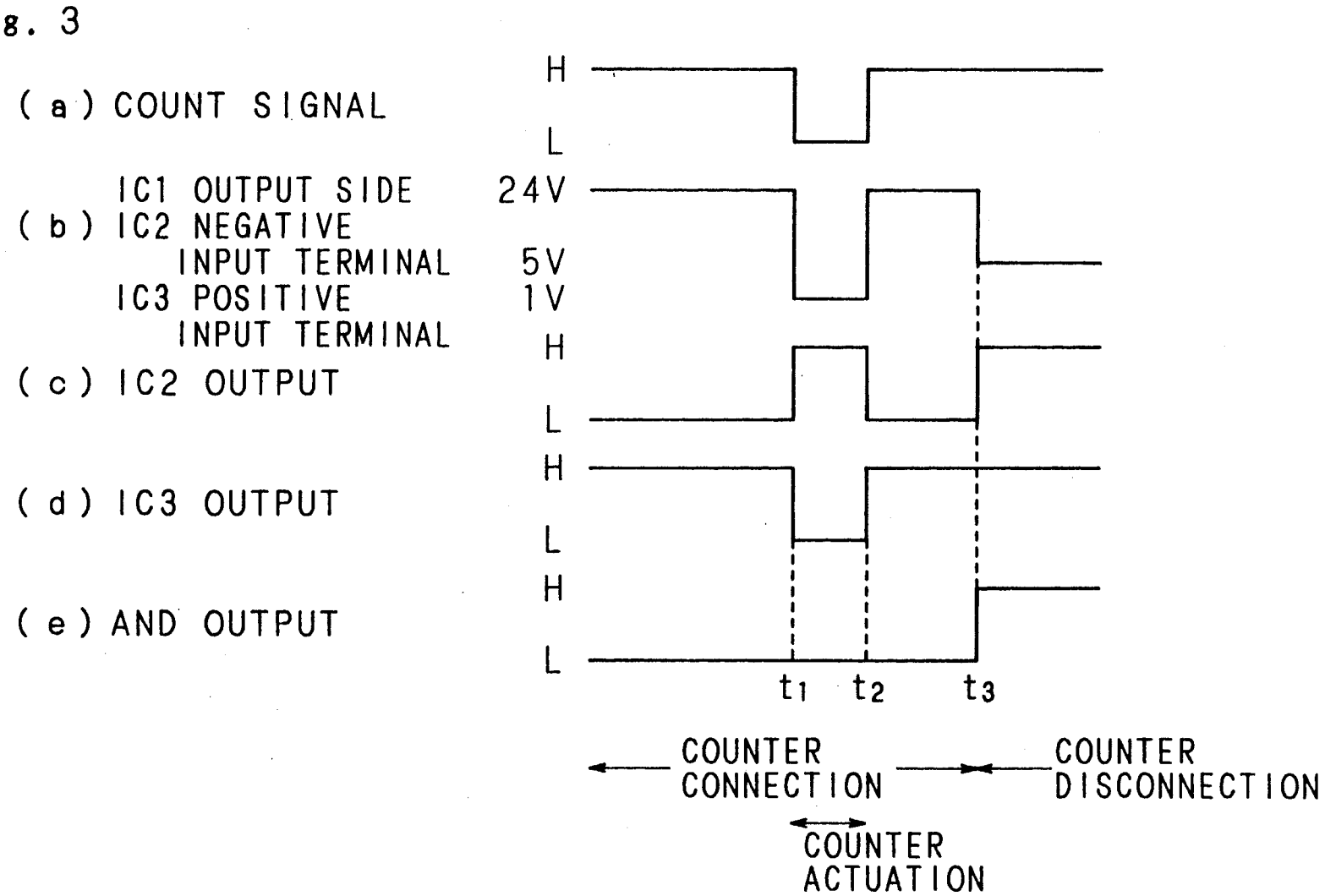
FIG. 3 is a timing chart of signals of each part of the electrical apparatus of FIG. 2.

While the counter 4 is connected with the copying apparatus, up to a time point t1 without an actuating signal outputted to the output port $\bar{b}$ of the CPU 2, the output port $\bar{b}$ is held at the "H" level as shown in FIG. 3(*a*) and the input side of the open-collector circuit IC1 is at the "H" level. The output side of the open-collector circuit IC1 goes to a high impedance, allowing the voltage of the power source V24, 24 volts, to be added to the output side of the open-collector circuit IC1, negative input terminal (−) of the comparator IC2, and positive input terminal (+) of the comparator IC3 via the counter relay CR of the counter 4 as indicated in FIG. 3(*b*).

At this time, a reference voltage of 10 V is applied to the positive input terminal (+) of the comparator IC2 and the output terminal of comparator IC2 goes to the "L" level as shown in FIG. 3(*c*). Likewise, a reference voltage of 3 V is applied to the negative input terminal (−) of the comparator IC3, the comparator IC3 generates a "H" level output as in FIG. 3(*d*). Consequently, the output of the AND circuit AND goes to the "L" level, as illustrated in FIG. 3(*e*), driving the input port $\bar{a}$ of the CPU to "L" level, whereby the CPU 2 detects the connection of the counter 4 with the copying apparatus. Thus, a copy instruction is enabled.

During the interval between the time point t1 when an actuating signal is output to the output port $\bar{b}$ of the CPU 2 starting the counter 4 and a time point t2, as indicated in FIG. 3(*a*), the output port $\bar{b}$ is at the "L" level and the input side of the open-collector circuit IC1 is "L" level. Therefore, the output side of the open-collector circuit IC1 becomes approximately 1.5 V as shown in FIG. 3(*b*), thereby flowing a current in the counter rely CR to actuate the counter 4. The counting value is increased one. The outputs from the comparators IC2 and IC3 are respectively at the "H" level and at the "L" level as shown in FIGS. 3(*c*) and (*d*). Accordingly, the output of the AND circuit AND stay at the "L" level and is input to the input port $\bar{a}$ of the CPU 2. The CPU 2 detects that the counter 4 is connected with the copying apparatus. The CPU 2 is enabled, generating a copy instruction signal (not shown) in response to an actuating signal. Accordingly, copying is carried out.

After time point t3 with the counter 4 disconnected from the copying apparatus and without an actuating signal being output to the output port $\bar{b}$ of the CPU 2, the output port $\bar{b}$ is, as indicated in FIG. 3(*a*), at the "H" level and the output side of the open-collector IC1 is a high impedance. Therefore, both the negative input terminal (−) of the comparator IC2 and positive input terminal (+) of the comparator IC3 are changed to 5 V because of the voltage of the power source V1 as shown in FIG. 3(*b*). The output of the comparator IC2 goes to the "H" level as shown in FIG. 3(*c*) and the output of the comparator IC3 goes to the "H" level, as shown in FIG. 3(*d*). As a result, the output of the AND circuit AND goes to the "H" level, as shown in FIG. 3(*e*). Input port $\bar{a}$ of the CPU 2 is driven to the "H" level and CPU 2 detects that the counter 4 is separated from the copying apparatus. The CPU 2 is disabled from generating a copy instruction signal, thereby making copying impossible. Improper use of the counter and unauthorized use of the copy apparatus is prevented in this manner.

Table 1 below indicates the relation between the actuating signal and output from the AND circuit AND when the counter is connected or disconnected.

TABLE 1

| | Actuating signal (H) | Actuating signal (L) |
|---|---|---|
| when counter is connected | AND output "L" | AND output "L" |
| when counter is disconnected | AND output "H" | AND output "L" |

When the actuating signal is output without the counter 4 connected, it can be detected that the counter is not connected. However, the copying apparatus is stopped when the counter 4 is disconnected and the CPU 2 cannot output an actuating signal. Further, if the counter 4 is disconnected when an actuating signal is output, although it is possible to forcibly output the actuating signal in the disconnected state of the counter 4, the actuating signal is cancelled after a predetermined time period. Therefore, the disconnection can be determined at that time point and since counting is already finished no actual harm occurs.

Figure 4:
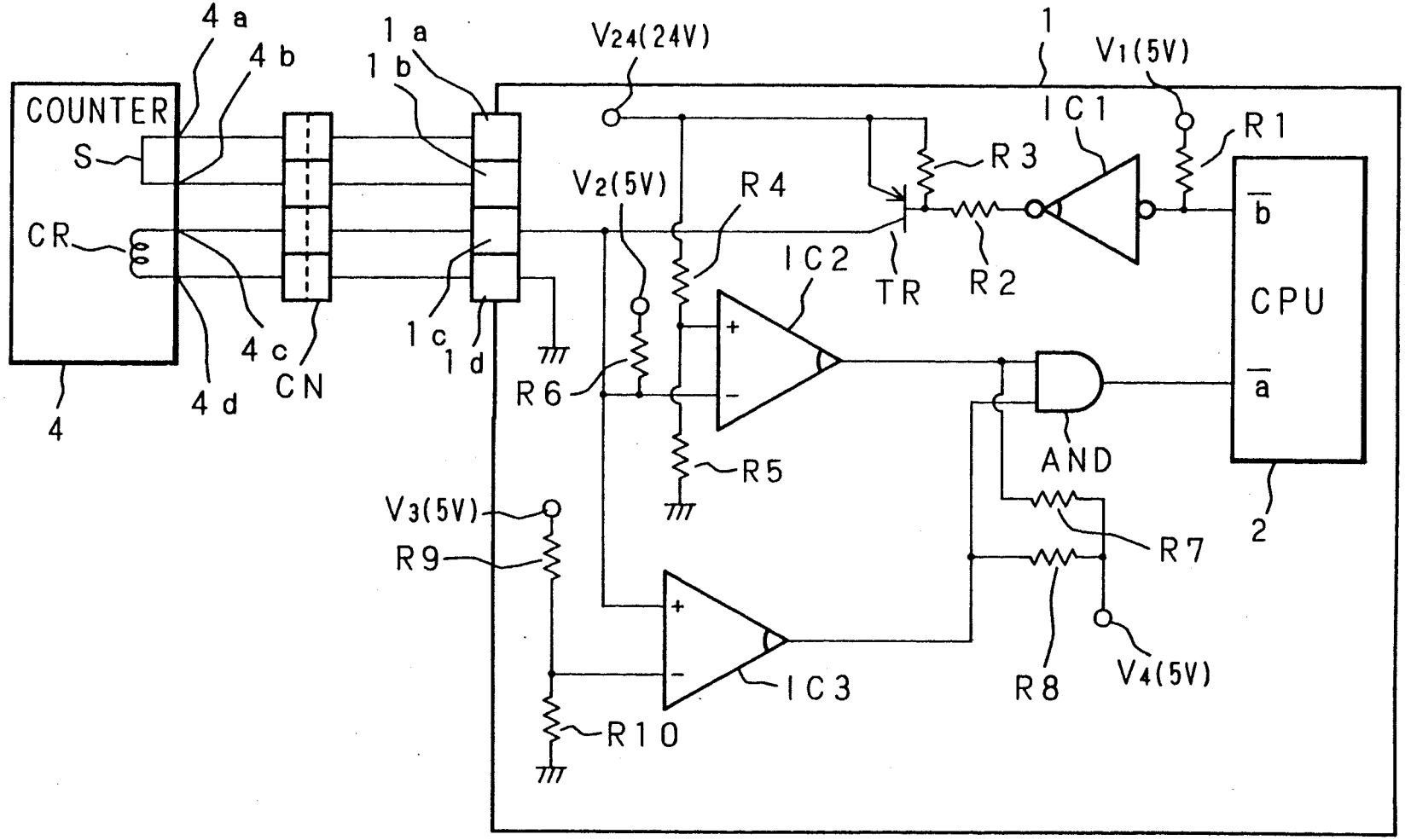
FIGS. 4, 5 and 6 are structural block diagrams of an electrical apparatus according to the other embodiments of this invention.

FIG. 4 shows an electrical apparatus according to the second embodiment of this invention. In FIG. 4, a main body 1 of a copying apparatus is provided with counter connecting terminals 1*a*, 1*b*, 1*c*, 1*d*. An output port $\bar{b}$ of a CPU 2 is connected to a power source V1 of, e.g., 5 v through a resistance R1 and to an input side of an open-collector circuit IC1. An output side of the open-collector circuit IC1 is connected to a base of a transistor TR through a resistance R2. A resistance R3 is connected between the base and an emitter of the transistor TR. The emitter of the transistor TR is connected to a power source V24 of, e.g., 24 V and, to a positive input terminal (+) of a comparator IC2 through a resistance R4. The positive input terminal (+) of the comparator IC2 is earthed through a resistance R5. A collector of the transistor TR is connected to the counter connecting terminal 1*c*, a negative input terminal (−) of the comparator IC2 and a positive input terminal (+) of a comparator IC3. The collector of the transistor TR is also connected to a power source V2 through a resistance R6.

A negative input terminal (−) of the comparator IC3 is connected to a power source V3 through a resistance R9 and earthed through a resistance R10. Outputs of the comparators IC2 and IC3 are each input to separate input terminals of an AND circuit AND. Each input terminal of the AND circuit AND is connected to a 5 V power source V4 through a resistance R7, R8. The output terminal of the AND circuit AND is connected to the input port $\bar{a}$ of the CPU 2. The counter connecting terminal 1*d* is grounded. The counter connecting terminals 1*a*, 1*b* are connected to short-circuit connecting terminals 4*a* and 4*b* of a counter 4 through a detachable connector CN. A short circuit S is connected between the connecting terminals 4*a* and 4*b*. The counter connecting terminals 1*c*, 1*d* are respectively connected to a power terminal 4*c* and an actuatin signal terminal 4*d* of the counter 4 through the connector CN. A counter relay CR for actuating the counter 4 is connected between the terminals 4*c* and 4*d*.

The operation of the electrical apparatus of the second embodiment will be discussed below. If an actuating signal is not given to the output port $\bar{b}$ of the CPU 2 while the counter 4 is connected to the copying apparatus, the input side of the open-collector circuit IC1 is at the "H" level and the output side thereof is a high impedance. This takes the voltage at the base of the transistor TR high. The transistor TR is turned OFF, without a current flowing to the counter relay CR of the counter 4. A voltage close to the grounding level is applied to the negative input terminal (−) of the comparator IC2 and positive input terminal (+) of the comparator IC3. As mentioned earlier, since a reference voltage of 10 V is applied to the comparator IC2 and a reference voltage of 3 V is applied to the comparator IC3, the output of the comparator IC2 is at the "H" level, and the output of the comparator IC3 is at the "L" level, and the output of the AND circuit AND goes to the "L" level. Accordingly, it is detected that the counter 4 is connected to the copying apparatus.

If an "L" level actuating signal is given to the output port $\bar{b}$ by the CPU 2 to start the counter 4, the input side of the open-collector circuit IC1 goes to the "L" level, and the output side thereof goes to the "L" level, thereby turning ON the transistor TR. As a result, a current flows to the counter relay CR through the transistor TR to the counter relay CR. The counter 4 starts counting, incrementing the counting value one. When the transistor TR is turned ON, 24 V is supplied from the power source V24 to the negative input terminal (−) of the comparator IC2 and positive input terminal (+) of the comparator IC3. The output of the comparator IC2 goes to the "L" level and the output of comparator IC3 goes to the "H" level. The AND circuit AND generates an "L" level output signifying connection between the copying apparatus and the counter 4. The CPU 2 is enabled to generate a copy instruction signal in response to the actuating signal.

When counter 4 is detached from the copying apparatus, without an actuating signal given to the output port b, the input side of the open-collector circuit IC1 is at the "H" level and the output side thereof is a high impedance, thereby turning OFF the transistor TR. No current flows in the counter relay CR of the counter 4. A voltage of 5 V is supplied to the negative input terminal (−) of the comparator IC2 and positive input terminal (+) of the comparator IC3 from power sources V2 and V3 respectively. If a reference voltage for the comparator IC2 is set to be 10 V and a reference voltage for the comparator IC3 is set to be 3 V, both outputs of the comparators IC2 and IC3 are at the "H" level, so that the output of the AND circuit and goes to the "H" level. Accordingly, the CPU 2 detects that the counter 4 is disconnected from the copying apparatus and will not generate a copy instruction signal.

The relation between the actuating signal and signal level of each part when the counter is connected or disconnected is tabulated in Table 2 below.

TABLE 2

| | With counter connected, without actuating signal | Without counter connected, with actuating signal | Without counter connected, without actuating signal |
|---|---|---|---|
| IC1 input | H | L | H |
| IC2/IC3 input | L(0 V) | H(24 V) | H(5 V) |
| IC2 output | H | L | H |
| IC3 output | L | H | H |
| AND output | L | L | H |

In an electrical apparatus of the third and the fourth embodiments of this invention, described as follows, a counter is provided only with connecting terminals for a counter relay.

Figure 5:
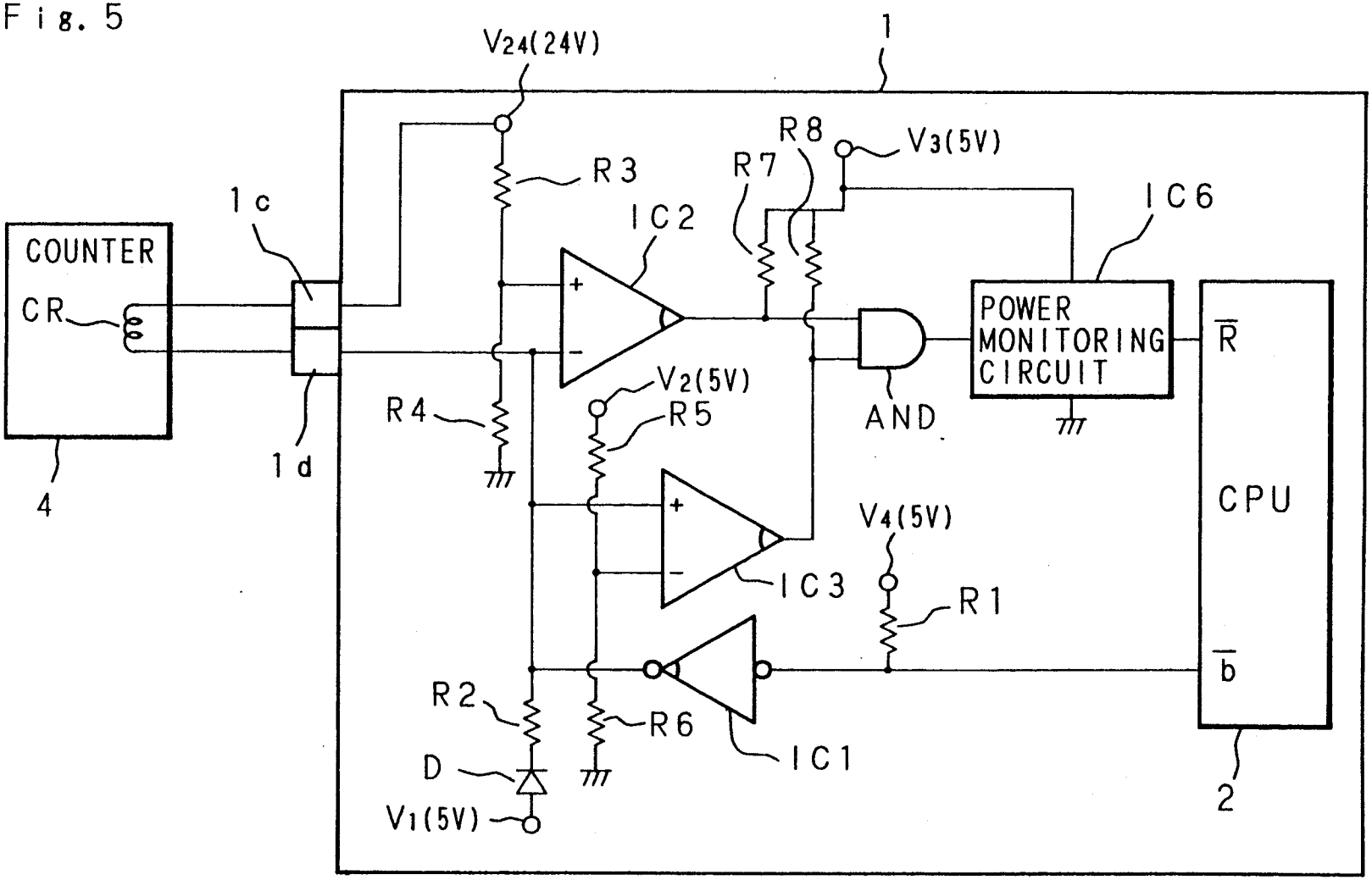

Referring to FIG. 5 showing an electrical apparatus according to the third embodiment, two counter connecting terminals 1*c*, 1*d* are provided in a main body 1 of a copying apparatus. A counter 4 has a counter relay CR which updates the counting value of the counter and is electrically connected to the counter connecting terminals 1*c* and 1*d*. An output terminal of an AND circuit AND is connected to an input terminal of a power monitoring circuit IC6. An output terminal of the power monitoring circuit IC6 is connected to a reset terminal $\bar{R}$ of a CPU 2. A power terminal of the power monitoring circuit IC6 is connected with a power source V3, with a grounding terminal thereof being earthed. The structure of the copying apparatus is identical to that of the circuit shown in FIG. 2 except for the aforementioned points.

According to the third embodiment, when the counter 4 is connected with the copying apparatus, a reference voltage of 10V is applied to a positive input terminal (+) of a comparator IC2, so that the comparator IC2 generates an "L" level output. Since a reference voltage of 3V is applied to a negative input terminal (−) of a comparator IC3, the comparator IC3 generates an "H" level output. The AND circuit AND outputs an "L" level output. The output of the AND circuit AND is given to the power monitoring circuit IC6, if the signal to the circuit IC6 is at the "L" level, it is detected that the voltage of a power source V24 is normal and the power source V24 is connected with the counter 4. In this case, the monitoring circuit IC6 will not output a signal to the reset terminal $\overline{R}$ of the CPU 2. When the CPU 2 is not reset, it is enabled to output a copy instruction signal and copying is performed.

When counter 4 is detached, both outputs of the comparators IC2 and IC3 are at the "H" level, and the output of the AND circuit AND is at the "H" level. As a result, the power monitoring circuit IC6 generates a reset signal to the reset terminal $\overline{R}$ of the CPU 2. The CPU 2 is reset, disabling it from generating a copy instruction signal. Therefore, if the counter 4 is separated from the copying apparatus, copying is not possible, whereby the improper use of the counter and the copying apparatus are prevented.

Figure 6:
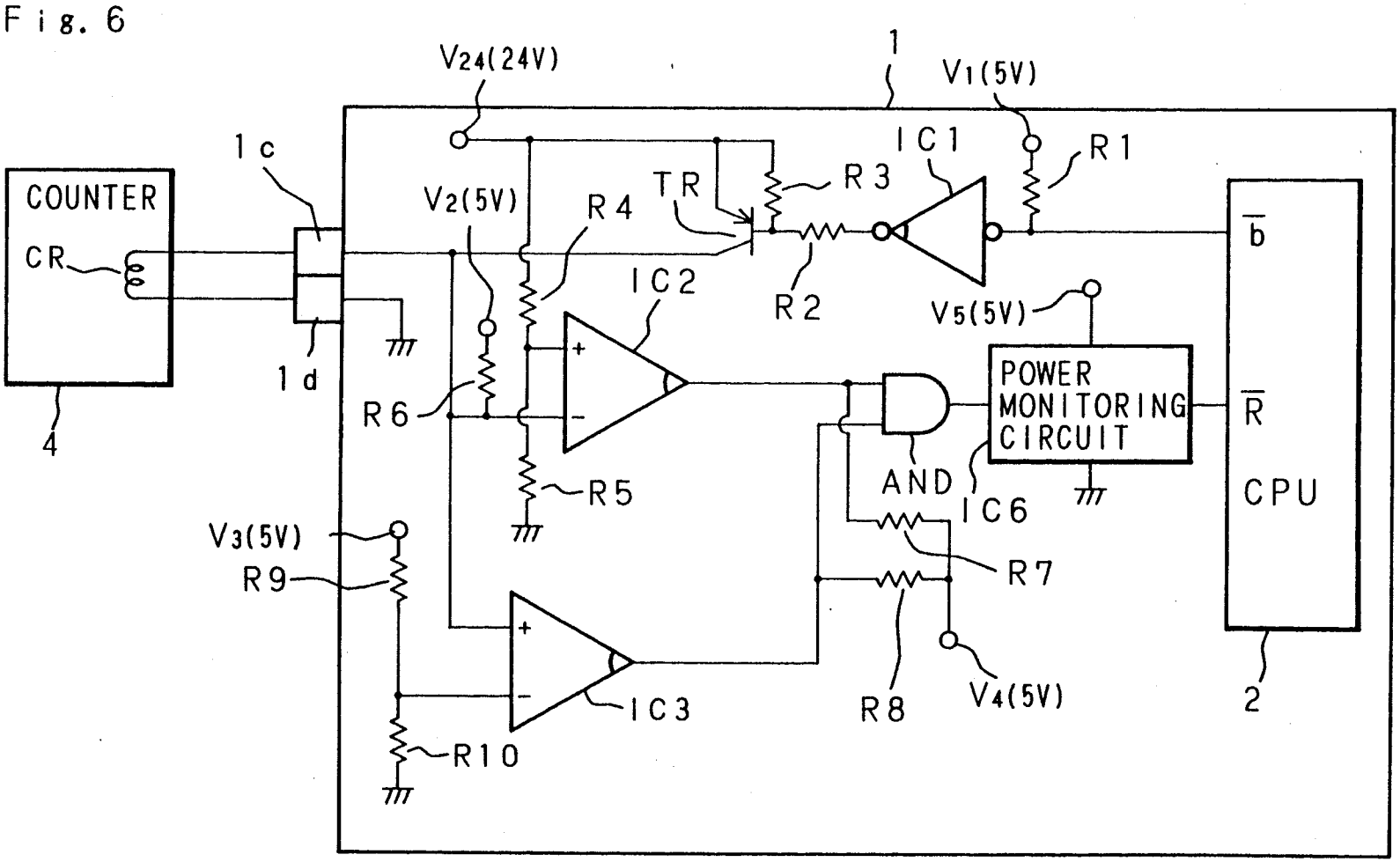

Referring further to FIG. 6 which illustrates an electrical apparatus of the fourth embodiment, there are two counter connecting terminals 1*c*, 1*d* provided in a main body 1 of the copying apparatus. A counter 4 has a counter relay CR for updating the counting value thereof. The counter 4 is connected to the copying apparatus in a manner that the counter relay CR is electrically connected between the connecting terminals 1*c* and 1*d*. The output terminal of an AND circuit AND is connected to an input terminal of a power monitoring circuit IC6 which has an output terminal connected to a reset terminal $\overline{R}$ of a CPU 2. A power terminal and a grounding terminal of the power monitoring circuit IC6 are connected to a power source V5 and the earth, respectively. The structure of the fourth embodiment is the same as shown in FIG. 4 except for the above-described points.

While the counter 4 is connected with the copying apparatus in the fourth embodiment, when an "L" level actuating signal is output from an output port $\overline{b}$ by the CPU 2, the output side of an open-collector circuit IC1 goes to the "L" level and a transistor TR is turned ON. The output of the comparator IC2 goes to the "L" level, whereas the output of the comparator IC3 goes to the "H" level. The output of the AND circuit AND is changed to the "L" level. The power monitoring circuit IC6 does not generate a reset signal. The CPU 2 does not prohibit generation of a copy instruction signal and copying is permitted by the copy instruction signal output in response to the actuating signal after the counter 4 has counted.

If the counter 4 is separated from the copying apparatus, the output of the comparator IC2 is goes to the "H" level, and the output of the comparator IC3 goes to the "H" level. The output of the AND circuit AND goes to the "H" level. Therefore, the power monitoring circuit IC6 generates a reset signal to the reset terminal $\overline{R}$ of the CPU 2. The CPU 2 is reset and unable to generate a copy instruction signal. Accordingly, copying is not possible if the counter 4 is detached from the copying apparatus, thereby preventing the improper use of the counter and the copying apparatus.

In an additional exemplary embodiment, the voltage applied to the negative terminal of comparator IC2 alternatively can be input directly to the CPU 2. Voltage levels signifying the connection or disconnection of counter 4 can be recognized by programming installed in CPU 2. This programming also functions to enable generation of a copy instruction signal when counter 4 is connected, and to disable generation of a copy instruction signal when counter 4 is disconnected.

Moreover, this invention is not limited to a copying apparatus although the foregoing descriptions are related to exemplary embodiments counting the number of copies made by a copying apparatus.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An electrical apparatus for performing a specific operation, comprising:

a counter for counting a number of said specific operations;

a counter driving circuit being connected to said counter and supplying a driving voltage to said counter on the basis of an actuating signal;

monitoring means for monitoring a voltage at a predetermined position of said counter driving circuit and outputting a result; and controlling means for controlling allowance of or prohibition of said specific operation in accordance with said result of said monitoring means.

2. An electrical apparatus according to claim 1, wherein said counter driving circuit includes a first circuit which is connected to said counter and is provided with a power source for generating said driving voltage to said counter, and a second circuit which connects said counter with a ground.

3. An electrical apparatus according to claim 2, wherein said first circuit has a switching member for switching between a first closed position and a first open position in accordance with said actuating signal, and said monitoring means monitors a voltage at said predetermined position between said switching member and said counter.

4. An electrical apparatus according to claim 3, wherein said counter driving circuit has a voltage supplying means for supplying a predetermined voltage lower than said driving voltage to said predetermined position, said monitoring means monitors whether said predetermined voltage is supplied to said predetermined position or said predetermined position is grounded, and said controlling means prohibits said specific operation of said electrical apparatus in response to a first predetermined result output by said monitoring means.

5. An electrical apparatus according to claim 4, wherein said controlling means allows said specific operation to be performed when said switching member is in said first closed position.

6. An electrical apparatus according to claim 2, wherein said second circuit has a switching member for switching between a second closed position and a second open position in accordance with said actuating signal, and said monitoring means monitors a voltage at said predetermined position between said switching member and said counter.

7. An electrical apparatus according to claim 6, wherein said monitoring means monitors whether or not said driving voltage is supplied to said predetermined position, and said controlling means allows said specific operation of said electrical apparatus in response to a second predetermined result output by said monitoring means.

8. An electrical apparatus according to claim 7, wherein said controlling means allows said specific operation to be performed when said switching member is in said second closed position.

9. An electrical apparatus according to claim 1, wherein said electrical apparatus is a copying apparatus.

10. An electrical apparatus for performing a specific operation, comprising:

a counter for counting a number of said specific operations;

connecting means which has a first connecting part which connects said counter with a power source for outputting a driving voltage for said counter, and a second connecting part which connects said counter with a ground;

a counter driving circuit which supplies said driving voltage between said first and second connecting parts on the basis of an actuating signal;

monitoring means for monitoring a voltage at a predetermined position of said counter driving circuit and outputting a result; and controlling means for controlling allowance of or prohibition of said specific operation in accordance with said result of said monitoring means.

11. An electrical apparatus according to claim 10, wherein said counter driving circuit has a switching member between said power source and first connecting part for switching between a first closed position and a first open position in accordance with said actuating signal, and said monitoring means monitors a voltage at said predetermined position between said first connecting part and switching member.

12. An electrical apparatus according to claim 11, wherein said counter driving circuit has a voltage supplying means for supplying a predetermined voltage lower than said driving voltage to said predetermined position, said monitoring means monitors whether said predetermined voltage is supplied to said predetermined position or said predetermined position is grounded, and said controlling means prohibits said specific operation of said electrical apparatus in response to a first predetermined result output by said monitoring means.

13. An electrical apparatus according to claim 12, wherein said controlling means allows said specific operation to be performed when said switching member is in said first closed position connecting said power source with said first connecting part.

14. An electrical apparatus according to claim 10, wherein said counter driving circuit has a switching member between said second connecting part and said ground for switching between a second closed position and a second open position in accordance with said actuating signal, and said monitoring means monitors a voltage at said predetermined position between said second connecting part and switching member.

15. An electrical apparatus according to claim 14, wherein said monitoring means monitors whether or not said driving voltage is supplied to said predetermined position, and said controlling means allows said specific operation of said electrical apparatus in response to a second predetermined result output by said monitoring means.

16. An electrical apparatus according to claim 15, wherein said controlling means allows said specific operation to be performed when said switching member is in said second closed position connecting said second connecting part with the ground.

17. An electrical apparatus according to claim 10, wherein said electrical apparatus is a copying apparatus,

* * * * *